United States Patent [19]

Wittrisch

[11] Patent Number: 4,905,774

[45] Date of Patent: Mar. 6, 1990

[54] PROCESS AND DEVICE FOR GUIDING A DRILLING TOOL THROUGH GEOLOGICAL FORMATIONS

[75] Inventor: Christian Wittrisch, Rueil Malmaison, France

[73] Assignee: Institut Francais du Petrole, Rueil Malmaison, France

[21] Appl. No.: 54,862

[22] Filed: May 27, 1987

[30] Foreign Application Priority Data

May 27, 1986 [FR] France ..... 86 07692

[51] Int. Cl.[4] ..... E21B 7/04; E21B 47/026

[52] U.S. Cl. ..... 175/26; 175/45; 175/50; 175/61; 175/73

[58] Field of Search ..... 175/26, 45, 50, 61, 175/73, 24, 41, 62; 73/152

[56] References Cited

U.S. PATENT DOCUMENTS

| | | | |
|---|---|---|---|
| 2,917,704 | 12/1959 | Arps | 175/50 X |
| 3,353,612 | 11/1967 | Bannister | 175/50 X |
| 4,077,657 | 3/1978 | Trzeciak | 175/61 X |
| 4,164,871 | 8/1979 | Cole et al. | 175/24 X |
| 4,303,135 | 12/1981 | Benot | 175/73 |
| 4,452,075 | 6/1984 | Bockhorst et al. | 175/45 X |
| 4,601,353 | 7/1986 | Schuh et al. | 175/41 |
| 4,637,479 | 1/1987 | Leising | 175/26 |
| 4,637,480 | 1/1987 | Obrecht et al. | 175/45 |
| 4,697,650 | 11/1987 | Fontenot | 175/50 |

FOREIGN PATENT DOCUMENTS

| | | | |
|---|---|---|---|
| 991298 | 6/1976 | Canada | 175/26 |

*Primary Examiner*—Hoang C. Dang

*Attorney, Agent, or Firm*—Antonelli, Terry & Wands

[57] ABSTRACT

A process and device making possible the guidance of the drilling tool through geological formations including an analytical device for directional geological analysis that carries out measurements as the drilling advances for guiding the drilling tool through the geological formation. The drilling column at its lower end includes the drilling tool (1) driven by a turbine (2) mounted on an elbow (4), a directional analytical device (3) that carries out measurements according to well set directions, a logging sensor (5), a drilling sensor (6) and a topographic probe (7). When drilling through specific geological formations, the information provided by the directional analytical device (3) is used for guiding the drilling tool in real time.

16 Claims, 1 Drawing Sheet

PROCESS AND DEVICE FOR GUIDING A DRILLING TOOL THROUGH GEOLOGICAL FORMATIONS

Figure 1:
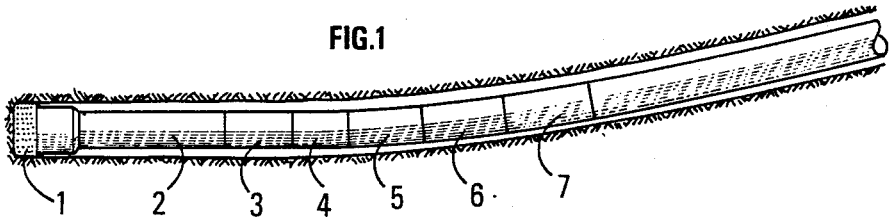

This invention concerns a process and a device for performing a drilling, in a quasi-interactive manner inside geological formations based on information pertaining to geological formations that have been pierced and/or in the vicinity of the well, and probably of the positions of the tool that executes the drilling.

This invention makes it possible especially during the drilling to follow selected geological formations, such as mining formations like coal veins, or specific oil formations.

This invention also enable the execution of integral or directional geological measurements of the sites that have been pierced and topographical drilling measurements in the course of drilling.

By integral geological measurements, it is meant measurements which characterize a pseudo-spherical site space centered on the probe.

By concentrated geological measurements, it is meant measurements which characterize a pseudo-cylindrical site space of which the axis corresponds more or less to that of the probe, or to that of the well and the thickness of which is reduced.

By directional geological measurements, it is meant measurements which characterize a narrow angular pseudo-sector of a pseudo-cylindrical site space of which the axis corresponds more or less to that of the probe, or to that of the well.

The prefix "pseudo" applies to the words spherical, cylindrical or sector, which characterizes the measurement spaces, is connected with the fact that heterogeneity of geological formations in question, which include the site and the well, alters the ideal geometry of the measurement space.

Conventional drilling techniques use, to guide the advance of a drilling, information concerning the geological formations that are pierced and/or the topography of the well and/or the mechanical elements, such as the well, which operate the drilling.

According to the nature of these bits of information the information can reach the operator who is guiding the drilling with more or less delay. This is due to the fact that some analyses, such as accurate geological analyses, are not performed during drilling proper, and require for their execution the interruption of drilling, probably the withdrawal of the drilling tool and/or part or all of the drilling tube.

These difficulties for obtaining such information in real time are especially sensitive in the execution of directed drilling which requires frequent alterations of the trajectory of the drilling tool.

Indeed, according to the prior art, for instance, when it is desire, with measuring techniques during drilling designated by the abbreviation MWD i.e. "Measurement While Drilling", to follow one or several specific geological formations, which might be very narrow (between 1 and 5 meters), one must wait for the bit to have pierced the formation or to be close to the desired geological boundary to be able to alter its trajectory. Indeed, the traditional measuring techniques are much less sensitive to site changes than directional analysis techniques are. The reason might stem from the relative variation of the measurement which is smaller in the first case than in the second. This translates into losses of time and costs which are both important.

This invention remedies those inconveniences by using directional analysis means that supply information in a quasiinstantaneous manner to the drilling operator instead of traditional integral or concentrated analysis means which are usually less sensitive and devoid of direction. That information along with such other information as reaches the operator directly, enable the operator to optimize the trajectory of the drilling tool and to know at the level of the analysis device the "dipmetry" of the geological boundary of the layers.

More specifically, this invention pertains to a guiding process for a directional drilling inside geological formations, by using an analytical device with which at least one set of measurements is carried out, based on the analytical device, information related to the measurements is supplied, and where as the drilling unfolds, said information is employed to guide said drilling. The device according to the invention is characterized in that said set of measurements is a set of geological measurements related to the pierced formations, and in that the set of measurements is conducted according to at least one known direction.

It is possible to conduct at least one set of geological measurements in three known directions.

At least one set of geological measurements can be a set of resistivity measurements.

Also in accordance with the invention at least one set of geological measurements can be conducted in four known directions of which at least one set of geological measurements can be a set of resistivity measurements.

Furthermore, a relative or absolute finding of the orientation of said direction of said measurement and/or of the drilling tool can be performed.

The analytical device can be activated by a rotation relative to the drilling axis.

Geological information with or without information from the finding(s) can automatically influence guidance of the drilling.

The process of this invention can be used to guide a drilling inside a specific geological formation, such as a layer of coil or a specific oil formation.

The guidance device which uses the process can include in combination:

- a directional analysis device of pierced geological formations,
- a directing drilling organ such as a tool driven by a turbine mounted on an elbow union.

The guidance device can also include finding means for the orientation of said direction of said measurement and/or the orientation of the drilling organ.

The analytical device can be located close to the drilling organ.

The directional analysis device can supply information on at least one subject contained in the geological formations.

The analytical device can be a fracture sensor.

The measurement direction of the analytical device can be more or less perpendicular to the axis of the drilling at the level of the analytical device.

The analytical device can be adapted to undergo measurements in several different directions.

The analytical device can turn in rotation in relation to the axis of the drilling.

The device can include remote controlled means of the directing drilling organ.

The control means can include information processing means supplied by the directional analysis device.

Figure 2:
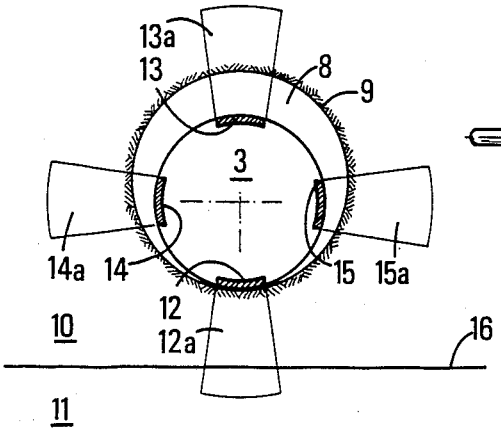
Figure 3:
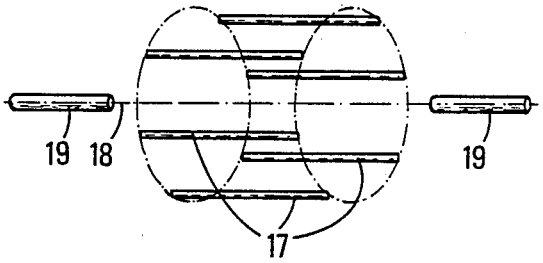
FIG.3 (PRIOR ART)
Figure 4:
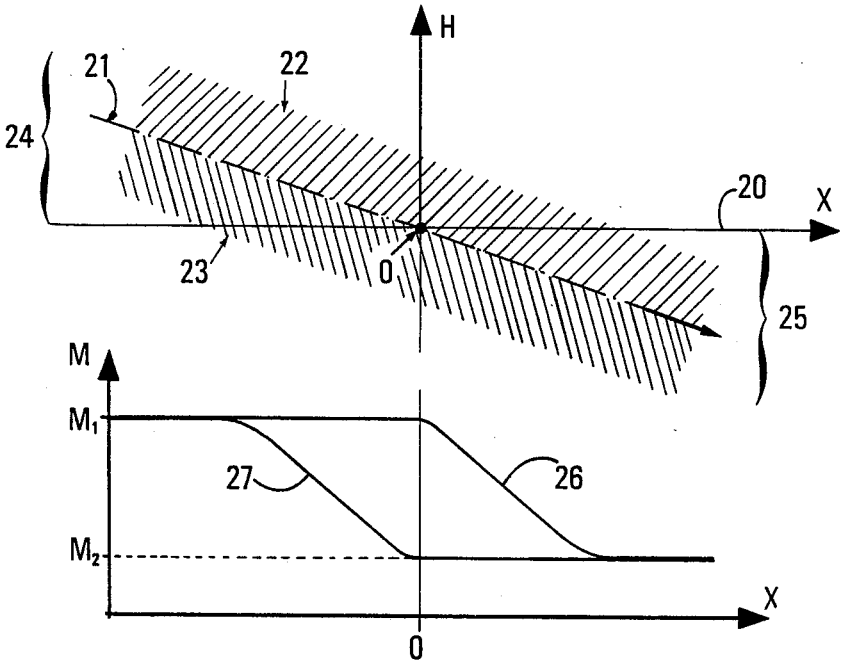

The invention can be better understood and all its benefits will be apparent from the following description, and the accompanying drawings wherein:

FIG. 1 schematically depicts, according to the invention, the arrangement of devices at the end of a drill pipe, such as the one used for directed drilling, FIG. 2 schematically illustrates a right sectional view in relation to the axis of a drill pipe, the measuring zones in geological formations of a directional analysis device which can be used to guide a drilling according to the invention;

FIG. 3 schematically shows a directional electric measurement device such as the one described in communication No. 20 of the Center for Geophysical Research of the National Center for Scientific Research; and FIG. 4 graphically depicts the possible evolution of measurements in a directional analysis performed during drilling according to the progress of the rectilinear piercing of a geological interface.

FIG. 1 illustrates a general configuration according to the invention of the end of a directed drill column which includes a drilling tool 1 that is fastened to an elbow 4. That elbow 4 makes it possible to obtain an angular tilt, for instance 1 to 2 degrees, between the axes of the drill column located on either side of the elbow and thus, by this means, to alter at any time the trajectory of the drilling tool 1 by rotating around itself the part of the elbow that is connected to the segment of the drill column which is linked to the surface, in the case of fixed angle elbow.

The drill tool 1 is driven by a turbine or an engine 2. This engine can be supplied by all sorts of energy sources such as hydraulic or electric.

As close as possible to the end of the well, or on the drill column as close as possible to the drilling tool, or upward (FIG. 1), or downward from the elbow 4, the directional analytical device 3, which supplies geological information to the drilling operator in well determined directions is placed, so as to detect changes in geological formations and be able to anticipate as early as possible trajectory alterations.

The operator can be a human being and/or a programmed robot, which reacts to variations of geological formations. The robot can be placed at the bottom of a well as well as on the surface. The robot can also use for its operation the topographical information on the site or the drilling, as well as mechanical information or other information. The human operator can follow and monitor all information that comes in and out of the robot.

The directional analytical device 3 makes it possible to conduct one or several sets of measurements related to formations which have been pierced in one or more directions. The kind of measurement is adapted so that the variation(s) can characterize the clear or unclear border(s) of geological formations which must be selected.

For example, where it is desired to work in a coal vein, resistivity measurements can be made. Resistivity measurements present the advantage on the one hand of expressing usually high contrast between veins of coal veins and of the veins and walls, on the other hand being directional, and also being sufficiently penetrating in the geological formations under consideration. All of those elements contribute to smooth and optimal guidance of the drilling.

As follow-up to other geological formations, it is possible to also measure, in one more selected directions, resistivity, or radioactivity, sound propagation, or the usual logging measurements such as physical and/or chemical measurements of which the typical values of formations under consideration can be distinguished Upward from the directional analysis device 3, or either before the elbow 4 (FIG. 1), it is possible to place logging sensors 5 which are traditionally used. With these sensors integral or global measurements, such as measurements for radiation, fluid resistivity, can be achieved.

Still upward from the directional anaysis device 3, there may be provided drilling sensors 6 such as those which measure the couple exerted by the drilling tool, the axial load of the tool, temperature, pressure, rotation speed of the engine 2. Such drilling sensors may be of the type disclosed in French patent FR-NO. 2 439 291.

Upward from the directional analysis device 3, a probe 7 is placed for topographical measurements. Probe 7 may include direction sensors which make it possible to carry out the topography of the drilling and its changes in direction. With this probe 7 it is possible to measure the azimuth, the tilt, and the tool angle. The follow-up of those parameters makes it possible to calculate the trajectory of the tool. Such topographic probes, for instance, are marketed under the name AZIMBEE, by the BENT-O-MATIC company, which is a subsidiary of the assignee. Some measuring probes are adapted to execute several kinds of measurements at the same time, like drilling measurements and topographical measurements.

The azimuth is the angle located in a horizontal earth plane and included between the orthogonal projections of the magnetic north direction and the axis of the drill column downward from the elbow.

The tilt is the angle located in the vertical earth plane that contains the axis of the drill column and included between the axis of the drill column and the vertical.

The tool angle is the angle located in a plane perpendicular to the axis of the drill column and included between the trace of the vertical plane that contains the axis of the drill column (or the projection of the magnetic north direction) and a reference plane which contains the axis of the pipe. Said reference plane can be defined by the axis of the drill column and the axis of the tool.

In the illustrative example that is described, the logging or topography instruments are attached to the drill column and do not require handling during drilling.

Alternatively, the logging or topography instrument may be placed in a removable probe, such as a probe which is supported by a cable. However, the described embodiment is preferred, for horizontal and highly deviated drillings.

The instruments for topographic, log or drilling measurements, can be placed differently following the directional analysis device. Furthermore, the absence of some of those instruments, even the restriction of all of them, will not prevent, according to the invention, the performance of drilling with the directional analytical device 3.

However the presence of those devices can only increase the effectiveness of drilling guidance according to the invention.

In order to better use the information from the directional analytical device 3, it is preferred, and is some cases crucial, to know the measurement direction(s).

If there are several measurement directions, the direction can be located on a single plane, and the measurement space divided into equal sectors for the purpose of facilitating the processing of the information thereby increasing site definition and providing better guidance to the drilling.

When those measurement directions are static one in relation to another, only one measurement direction, either in an absolute manner, or in a relative manner is needed.

The reference of a measuring direction may be made to coincide with the reference that provides the definition of the tool angle. Theoretically, the setting of measurement directions in relation to the tool reference angles makes it possible to ignore knowledge of the tool angle. However, practically speaking, knowledge of the tool reference angle is quasi-crucial for the conduct or drilling.

When the measuring directions are mobile around the axis of the tool or the axis of the drill column, it will be mandatory to know at each instant these measuring directions.

In the described configuration example, the alteration of the trajectory takes place as a result of an elbow union 4 by variation of the angle of tool 1, or by rotation around itself of part of the elbow union 4 connected to the portion of the pipe linked to the surface.

It is within the scope of this invention to use an elbow union 4 that has a variable angle. Any suitable means which makes it possible to deviate the direction of the drilling may be used.

The maneuvering of a variable angle union 4 can be controlled by an automatic operator. Such variable angle unions which can be controlled from the surface are marketed for instance under the name TELEPILOTE by the Bent-O-Matic company, a subsidiary of the assignee.

The drilling guidance unit, which includes the drilling tool 1, the turbine 2, the directional analytical device 3, the trajectory alteration means, such as the elow 4, optionally the logging, topography and drilling sensors which may be an integral part of the drill column, can be united with the surface facilities, either by a drill pipe unit, or by an adapted hose pipe.

Furthermore, the guidance unit can include information processing systems, electric generators, or any other device that can be used during or after drilling.

For instance, information processing can use multiplexing of electrical signals coming from different sensors. The information from the guidance unit, after processing, can reach the drilling pilot by means which are electrical (cables), optical (fibers), or mechanical (fluid transmission).

The arrangements of the turbine 2 and the engine or tool 1 allow the directional analytic device 3 to be positioned in close proximity to the end of the drill column.

FIG. 2 illustrate the principle of directional analysis, in a right section in relation to the axis of the drill column, at the position of the directional sensors of the analytical device 3.

Reference numeral 10 shows the geological formation that has been pierced by the well 9 in the process of being drilled wherein the drill column and especially the directional analytical device 3 is found.

The drill column is separated from the walls of the well 9 by the drilling fluid 8 of which the thickness around the column is not necessarily constant.

The neighboring geological formation 11, such as a wall, is separated from the geological formation 10 that has been pierced by the boundary 16. This geological formation boundary is usually neither a plane, nor clear by delineated, because adjacent geological formations interpenetrate along a certain thickness that can extend to several decimeters.

FIG. 2 shows in a schematic manner a directional analytical device 3 which allows for logging, resistivity measurements along four measurements sections 12*a*, 13*a*, 14*a*, 15*a* of which each is located along the axis of one of the respective measuring electrodes 12, 13, 14, 15. The axes of electrodes 12, 13, 14, 15 are placed in quadrature within the same plane.

The placement of the quadrature axes 12, 13, 14, 15 benefits the definition of a simple finding system which enables, from a reduced number of sensors, the obtaining of good geological definition of the site within a plane and around the probe, and of detecting site anomalies in complementary directions. Indeed, wheat can happen, for instance, is that during a drilling that goes through a specific mining formation, the upper wall comes abnormally close to the well. Knowledge of those measurements makes it possible to adjust quickly position of the drilling, for otherwise, if there had been only one measurement direction tool 1 located according to the internal plane sector that contains the elbow, detection would have been delayed.

Use of three measurement axes which define a measuring plane is also possible. However, better information is obtained by increasing the number of measuring axes.

Furthermore, when the number of measuring axes drops, the possible angle of the measuring sectors tends to increase. For specific kinds of measurements, the opening of the angle must be adapted in order to achieve compromise with regard to measuring sensitivity, accuracy and zone.

In the case of narrow sectors, sometimes, a certain continuity interpolation can be achieved between each.

The electric current, which stems from a generator with a pole in the ground and the other connected to the probe electrodes, circulating in each electrode, characterizes at a particular depth the resistivity of the site located in the measuring sectors related to each electrode. The knowledge of the value of the current makes it possible to determine resistance, conductivity, and spontaneous potential of geological formations facing the electrodes and located in the measuring sectors.

The generator that is used can be, for instance, a low frequency alternating current generator. A low frequency current (150 Hz for instance) has the advantage over a direct current of avoiding polarization of the electrodes. The electrodes can be comprised of conductive elements and/or toroidal transformers.

Depth of penetration of the measurement in the formations varies according to operating conditions (apparatus, site). With the current processes and directional resistivity measuring devices, penetrations between 30 centimeters and one meter can be located. The penetration depth increases when site resistance increases growth.

Examples of measuring techniques like those of concentrated resistivities are described by R. Desbrandes in "Theory and Interpretation of Loop" published by Technip in Paris (1968).

The measurement sectors 12*a*, 13*a*, 14*a*, 15*a* in practice are not identical to those illustrated in FIG. 2 which depict ideal sectors. The drilling fluid produces line loops of electric fields between the electrodes as well as alterations in measurements that vary according to the thickness of the fluid.

Moreover, the arrangement and the significance of the arcing horns or concentrating electrodes which are not depicted in Figure influence especially the measurement sectors.

Paper No. 20 of MOSNIER, delivered during the 4th symposium on Logging S.A.I.D. on Oct. 21, 1981 in Paris, of the Center for Geophysical Research of the National Center for Scientific Research, entitled "Localizing in Depth and in Azimuth of Conductive Fractures Inside an Electrically Resisting Encasing" descries a process and a device for executing directional electric measurements inside a well.

The experiment is applied to the detection of conductive fractures, especially those stemming from hydraulic fracturing, but it cannot apply to accurate localization, inside a polar depiction in relation to the axis of the well, of all the electrical anomalies that exist around the measurement device.

As illustrated in FIG. 3, the directional analytical device 3 can be comprised of a plurality of cylindrical extended electrodes 17, that are also distributed around the axis 18 of the analytical device 3. On either side of those measurement electrodes 17, there is an arcing horn 19. One or both of those arcing horns 19 can be provided by a part of the drilling column. The parts of the drilling column can serve as the mass. The current that flows inside the measurement electrodes can be detected either directly or by way of toroidal transformers. The electrical information can be processed before going up to the surface facilities.

Therefore, the construction of FIG. 3 provides a means for producing directional or polar logs by measuring the radial conductances from a well.

This device can be used to distinguish with electrical measurements, such as those allowed by this device, two adjacent geological formations, of which one only must be pierced by the drilling.

This device is especially usable to characterize the carboniferous formations where usually there is a high contrast in resistivity betwen the coal vein and its walls.

Hence in this case, knowledge of the direction and the proximity of the wall will allow advantageous means so as to be able to remain inside the vein and to optimize the trajectory of the tool.

FIG. 4 depicts graphically and schematically a probable evolution of measurements from a directional analysis conducted during drilling in relation to the progress of the pietcing of a geological interface.

In this instance, the analysis sectors were assumed to be narrow and belonged to a plane which was substantially perpendicular to the interface 20 between the two geological formations 24, 25. Those two formations could be characterized by distinct measurement values M1 and M2.

The plane XOH schematically depicts the plane in which the drilling tool moves which being perpendicular to the interface 20. The ordinate H gives the distance to the interface 20 which is depicted by the axis X. The drilling axis 21 cuts the plane XOH at O. The zones 22 and 23 correspond to measurement spaces of the direction sensors located in plane XOH.

For a motion of the drilling tool directed along the axis 21, the sensor which has the investigative zone 23, detects much earlier the interface 20 and the geological formation 25 than the sensor which has the investigative zone 22.

In practical terms, the illustrated investigation zones vary according to resistivity of the explored formation.

The XOM plane schematically depicts the evolution of measurement values 26 and 27 of the direction sensors with respectively the investigation zones 22 and 23 in relation to abscissa X to the interface 20. The value M1 is characteristic of the geological formation 24, whereas the value M2 is characteristic of the geological formation 25.

We note that the evolution of measurements 27 precedes by far the evolution 26 when we shift according to the oriented axis 21. In this way, if the values M1 and M2 are very different, we can detect very rapidly a site variation on a sensor like the one with evolution 27 and alter the trajectory of the tool. On the other hand, with the use of an integral or concentration device, the evolution might be delayed, the background noise increasingly hampering detection.

The illustrated example that is described makes preferential use of four direction sensors which not only have the advantage of providing good definition for measurements in complementary directions, but that of enabling a reading of the tilt of geological layers.

It is possible to increase or to reduce the number of sensor but the risk is that there might be confusion or lack of information. To have only 2 or 3 sensors and at the very least one of which the investigative zone would include the internal plane sector defined by the drilling axis and the axis of the tool when the latter is mounted on an elbow union. That zone could be identical to the investigative zone 24 depicted in FIG. 5.

However, use of a single direction sensor does not allow for comparative measures between sensors and can lead to errors in interpretation, especially because of variable fluid thickneses when electrical measurements are carried out and to errors in maneuvering.

It is also be possible, where desired, to achieve measurements all around the drilling column with the help of a direction sensor that revolves about the axis of the drilling column.

This means of analysis can be used to reduce the clearance or the cost of the directional analysis device. This can be especially the case with probes for measuring radioactivity or analyzing materials.

This type of apparatus requires automatically, as it has been previously described, an absolute or relative angular measurement of the analytical direction.

I claim:

1. A process for guiding the direction of a drilling tool advance along an axis of the tool through underground geological formations comprising:

providing an analytical device capable of detecting simultaneously in a plurality of specific directions different than the tool advance direction changes in geological properties that is mounted to move with said drilling tool;

generating signals responsive to detected geological changes of underground formations from said plurality of specific directions while the drilling tool is in operation;

said signals varying in accordance with changes in geological formations at positions which are near the drilling tool but outside the path traversed by the drilling tool;

processing said generated signals; and guiding said drilling tool by means operating in response to said processed signals.

2. A process according to claim 1 characterized in that the generated signals are representative of a set of geological meaurements taken in three predetermined specific directions.

3. A process according to claim 1 characterized in that the generated signals are representative of a set of geological measurements based on resistivity measurements.

4. A process according to claim 1 characterized in that the generated signals are representative of a set of geological measurements taken in four predetermined specific directions and at least one set of geological measurements is a set of resistivity measurements.

5. A process according to claim 1 further including the step of measuring the orientation of the direction of geological change detection with respect to the drill tool axis.

6. A process according to claim 1 wherein said drilling tool has a direction of movement along a progressing axis and said process further comprises rotating said analytical device about said progressing axis while said drilling tool is in operation.

7. A process according to claim 1, characterized in that said processed signals directly control guidance of said drilling tool without manual intervention.

8. A guidance device for use with a tool for drilling in geological formations comprising in combination:

a directional analytical device having means for simultaneously performing remote measurements in a plurality of specific directions different than the tool advance direction, said measurements being related to the geological formations in the vicinity of the drilling, said device supplying information in the form of signals;

means to modify said signals;

an elbow union having one end movable relative to the other end;

a directional drilling tool driven by a rotational drive means mounted on the movable end of said elbow union so that a drillng direction is controlled by the position of the elbow union; and means for controlling the position of the movable end of said elbow union in response to said modified signals.

9. A device according to claim 8, further comprising means to measure an orientation of said measurement direction in a plane substantially perpendicular to the drilling direction and the drilling direction is altered during drilling.

10. A device according to claim 8, further comprising means to vary an orientation of the drilling direction of the tool in increments of about 2° at a time in response to a corresponding movement of the movable end of said elbow union during drilling.

11. A device according to claim 8, wherein said directional analytical device is located in close proximity to said drilling tool.

12. A device according to claim 8, wherein said signals supplied by said directional analytical device concern a specific material contained in said geological formation.

13. A process for guiding the direction of a drilling tool advance along an axis of the tool through underground geological formations comprising:

providing an analytical device capable of detecting direction changes in resistivity measurements in a plurality of specific directions different than the tool advance direction, said device being mounted to move with said drilling tool;

generating signals responsive to detected resistivity measurements while the drilling tool is in operation;

said signals varying in accordance with changes in geological formations at positions which are near the drilling tool but outside the path traversed by the drilling tool;

processing said generated signals; and guiding said drilling tool advance direction by means operating in response to said processed signals.

14. A process according to claim 13 further including the step of measuring the orientation of the direction of geological change detection with respect to the drilling tool axis.

15. A process according to claim 13 wherein said drilling tool has a direction of movement along a progressing axis and said process further comprises rotating said analytical device about said progressing axis while said drilling tool is in operation.

16. A process according to claim 13, characterized in that said processed signals are based on changes in electrical resistivity measurements made simultaneously in at least two directions that are each substantially perpendicular to the tool advance direction and which directly control guidance of said drilling tool without manual intervention.

* * * * *